US009568016B2

(12) United States Patent
Crowley et al.

(10) Patent No.: US 9,568,016 B2
(45) Date of Patent: Feb. 14, 2017

(54) IMPELLER INTERNAL THERMAL COOLING HOLES

(71) Applicant: Dresser-Rand Company, Olean, NY (US)

(72) Inventors: Michael J. Crowley, Allegany, NY (US); Andrew J. Ranz, Enfield, CT (US); Byron L. Mohr, Olean, NY (US)

(73) Assignee: Dresser-Rand Company, Olean, NY (US)

( * ) Notice: Subject to any disclaimer, the term of this patent is extended or adjusted under 35 U.S.C. 154(b) by 370 days.

(21) Appl. No.: 14/255,147

(22) Filed: Apr. 17, 2014

(65) Prior Publication Data

US 2014/0314572 A1 Oct. 23, 2014

Related U.S. Application Data

(60) Provisional application No. 61/814,936, filed on Apr. 23, 2013.

(51) Int. Cl.

| | |
|---|---|
| ***F04D 29/66*** | (2006.01) |
| ***F04D 29/22*** | (2006.01) |
| ***F04D 29/28*** | (2006.01) |
| ***F04D 29/58*** | (2006.01) |

(52) U.S. Cl.

CPC ..... *F04D 29/2261* (2013.01); *F04D 29/284* (2013.01); *F04D 29/584* (2013.01); *F04D 29/588* (2013.01); *F04D 29/66* (2013.01)

(58) Field of Classification Search

CPC ..... F04D 29/584; F04D 29/588; F04D 29/66
USPC ..... 416/181, 182, 185
See application file for complete search history.

(56) References Cited

U.S. PATENT DOCUMENTS

| | | | | |
|---|---|---|---|---|
| 3,213,794 | A * | 10/1965 | Adams | F04C 19/00 416/181 |
| 4,769,092 | A | 9/1988 | Peichl et al. | |
| 4,890,980 | A | 1/1990 | Heald et al. | |
| H0777 | H | 5/1990 | Natarajan | |
| 5,336,050 | A * | 8/1994 | Guida | F04D 29/282 29/889.21 |
| 5,419,792 | A | 5/1995 | King et al. | |

(Continued)

FOREIGN PATENT DOCUMENTS

JP H11182491 A 7/1999

OTHER PUBLICATIONS

PCT/US2014/034866—International Search Report and Written Opinion of the International Searching Authority, dated Aug. 29, 2014, 12 pages.

*Primary Examiner* — R. K. Arundale

(57) ABSTRACT

An impeller may include a hub section, a plurality of blades, and a shroud. The hub section may be mounted on a rotatable shaft. The hub section may define a central opening for the rotatable shaft to extend therethrough and may define a plurality of holes disposed in a circular manner about the central opening. The plurality of blades may be connected to or integral with the hub section. The shroud may be connected to or integral with the hub section and the plurality of blades. The plurality of holes may be either through holes or partially drilled holes. A bottom of some or all of the partially drilled holes may be flat, conical, or rounded. Some or all of the partially drilled holes may have one or more bleed holes that may permit quenching material to flow therethrough and prevent the quenching material from stagnating therein.

20 Claims, 3 Drawing Sheets

(56) References Cited

U.S. PATENT DOCUMENTS

| | | | | |
|---|---|---|---|---|
| 5,465,575 | A * | 11/1995 | Shimmell | F16H 41/28 29/889.5 |
| 6,550,574 | B2 | 4/2003 | Liu | |
| 6,558,120 | B2 * | 5/2003 | Kim | F04D 25/12 416/186 R |
| 6,601,672 | B2 | 8/2003 | Liu | |
| 7,984,787 | B2 * | 7/2011 | Liu | F16L 55/052 181/213 |
| 2003/0077174 | A1 * | 4/2003 | Kim | F04D 29/283 416/186 R |
| 2006/0263200 | A1 | 11/2006 | Ahlroth et al. | |
| 2008/0118357 | A1 * | 5/2008 | Jeon | F04D 29/023 416/185 |
| 2008/0134713 | A1 * | 6/2008 | Choi | F04D 29/30 62/407 |
| 2010/0061841 | A1 | 3/2010 | Visintainer et al. | |
| 2010/0329849 | A1 | 12/2010 | Nishioka et al. | |
| 2012/0213637 | A1 * | 8/2012 | Jeon | F04D 29/162 416/185 |
| 2016/0090992 | A1 * | 3/2016 | Jayaram | F04D 29/2238 415/144 |

* cited by examiner

IMPELLER INTERNAL THERMAL COOLING HOLES

CROSS-REFERENCE TO RELATED APPLICATIONS

This application claims priority to U.S. Provisional Patent Application having Ser. No. 61/814,936, which was filed Apr. 23, 2013. This priority application is hereby incorporated by reference in its entirety into the present application to the extent consistent with the present application.

BACKGROUND

Impellers are generally known and typically include a hub section, for example, in a form of a disc mounted on a rotatable shaft, and a plurality of blades attached to the hub section. A shroud or side wall is connected to the hub section and the plurality of blades. The shroud may be connected to the hub section and the plurality of blades only on one side of the plurality of blades, and such an impeller is referred to as a semi-open impeller. Alternatively, the shroud may be connected to the hub section and the plurality of blades on both sides of the plurality of blades and, as such, encloses the plurality of blades. Such an impeller is referred to as an enclosed impeller. In some impellers, the shroud may be absent and such impellers are referred to as open impellers. In operation, fluid enters an impeller through an inlet opening located proximal to the shaft, flows radially outwardly through flow channels defined between the plurality of blades, and exits the impeller through one or more outlets located at the outer perimeter of the impeller.

During the hardening process step in the manufacturing of an impeller, the impeller may be heated to a required temperature and quenched in air, gas, and/or liquid. Often, the impeller is large in size and has a relatively thick hub section. The large size and the thickness of the hub section of the impeller may affect the heating and cooling rates of the material of the hub section. For example, when exposed to quenching material (air, gas and/or liquid), the material in a section of the impeller having a larger cross-sectional thickness (for example, material in and around a central opening of the hub section) may not cool as rapidly as compared to the material on the surface of the impeller and the material in a section of the impeller having a smaller cross-sectional thickness (for example, material on the periphery of the impeller). As a result, the material in and around the central opening of the hub section of the impeller may be softer than the material on the surface, and material in and around the periphery of the impeller. There may be, therefore, a difference in the microstructure of impeller material throughout the entire structure of the impeller. Consequently, the impeller may exhibit less than desirable mechanical properties, for example, reduced hardness, reduced compressive strength, reduced yield strength, or the like, in the hub section. This may result in deformities in the hub section of the impeller during operation. For example, the impeller may experience yielding during overspeed.

As a result, presently known methods utilized in an effort to improve the mechanical properties in the thick hub section include using new manufacturing methods which are not viable for larger impellers, using expensive materials which erode profit margin, using various types of heat treatments that provide less than the desired mechanical properties, and designing hub sections of different geometrical configurations.

What is needed, therefore, is a method of achieving the desired mechanical properties at the thick hub section without substituting the standard material or altering the present manufacturing processes.

SUMMARY

Embodiments of the disclosure may provide an impeller configured to be mounted on a rotatable shaft. The impeller may include a hub section. The hub section may define a central opening for the rotatable shaft to extend therethrough and may define a plurality of holes disposed in a circular manner about the central opening. The impeller may also include a plurality of blades connected to or integral with the hub section and a shroud connected to or integral with the hub section and the plurality of blades.

Embodiments of the disclosure may provide another impeller including a hub section. The hub section may define a central opening for a rotatable shaft to extend therethrough and may define at least one through hole and at least one partially drilled hole. A thickness of the hub section may decrease radially outward from the central opening, and the at least one through hole and the at least one partially drilled hole may be disposed in a circular manner about the central opening. The impeller may also include a plurality of blades connected to or integral with the hub section, and a shroud connected to or integral with the hub section and the plurality of blades.

Embodiments of the disclosure may provide yet another impeller. The impeller may include a hub section. The hub section may define a central opening for a rotatable shaft to extend therethrough and may define at least one partially drilled hole and one or more bleed holes. A thickness of the hub section may decrease radially outward from the central opening, and the at least one partially drilled hole and the one or more bleed holes maybe disposed in a circular manner about the central opening. The impeller may also include a plurality of blades connected to or integral with the hub section, and a shroud connected to or integral with the hub section and the plurality of blades.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
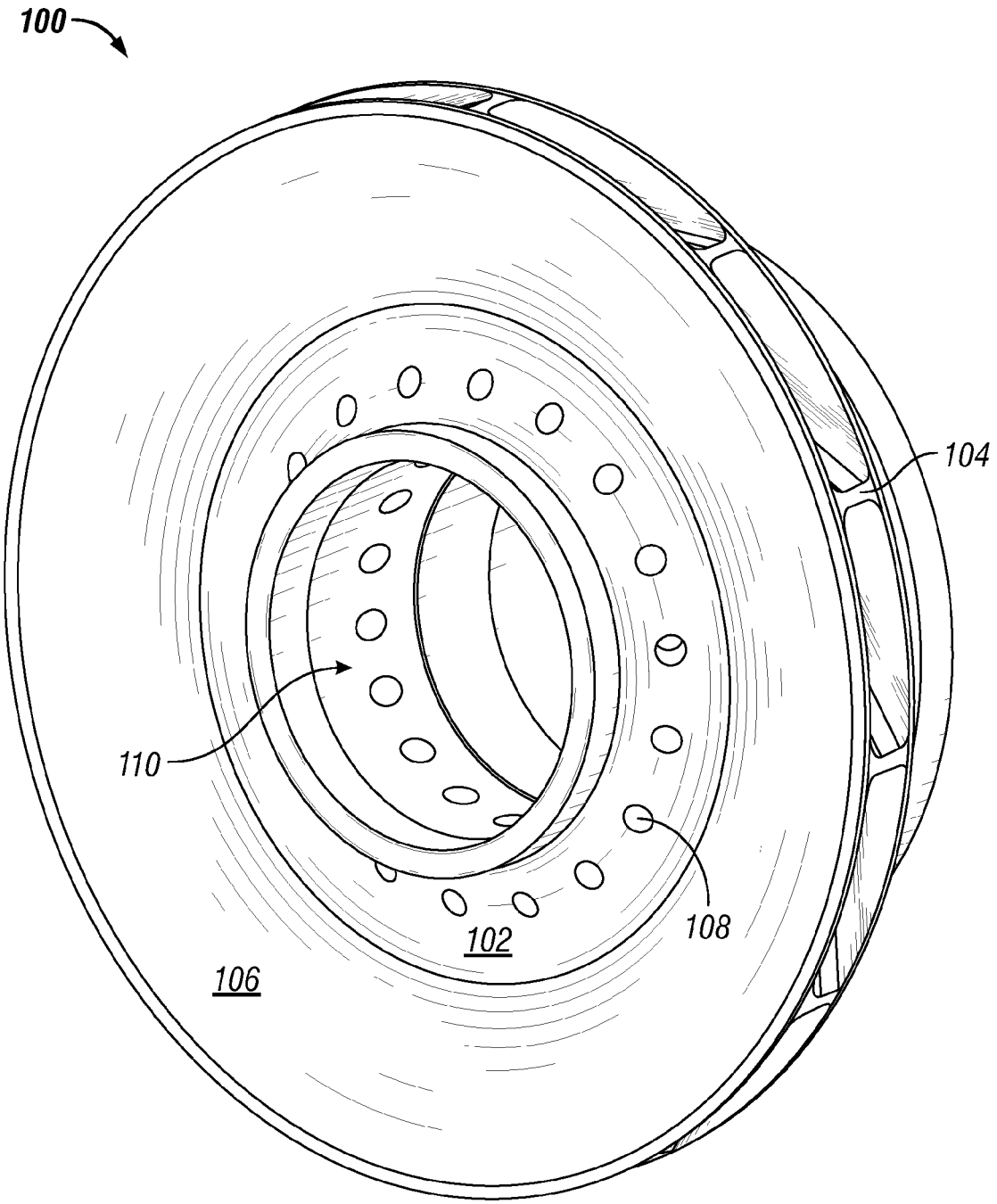
FIG. 1 illustrates a perspective view of an impeller, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a perspective view of an impeller 100, according to one or more embodiments disclosed. Although FIG. 1 illustrates an enclosed impeller, exemplary embodiments disclosed below are equally applicable to open and semi-open impellers. The impeller 100 may include a hub section 102 (for example, disk-shaped) defining a central opening 110 for a rotatable shaft to extend therethrough, a plurality of blades 104 connected to or integral with the hub section 102, a shroud 106 connected to or integral with the hub section 102 and the plurality of blades 104, and a plurality of holes 108 defined in the hub section 102. Although illustrated as being circular in shape, the shape and size of the holes is not limited thereto and the holes may be of any desired shape and size to fit any number of applications without departing from the scope of the disclosure. The thickness of the hub section 102 may decrease radially outward from the central opening 110 of the hub section 102. The plurality of holes 108 may be drilled into the hub section 102 proximal to the central opening 110 of the hub section 102 (for example, at the thickest location in the hub section 102) to allow quenching material to enter into the hub section 102. In an example embodiment, the plurality of holes 108 may be disposed in a circular manner about the central opening 110 of the hub section 102. As explained in detail below, the plurality of holes 108 may be either through holes or partially drilled holes. The plurality of holes 108 may be spaced at predetermined intervals (for example, at equal intervals) in the hub section 102. A thickness of the hub section 102 defining the plurality of holes 108 may be less than a thickness that may prevent hardening of the material of the hub section 102 during quenching. Also, a thickness of the hub section 102 between adjacent holes 108 may be less than a thickness that may prevent hardening of the material of the hub section 102 during quenching.

The configuration (for example, the shape and size) of the holes may permit the quenching material (air, gas and/or liquid) used in the quenching process to flow through the holes with relative ease and permit efficient removal of heat. The configuration of the holes may be such that the quenching material may not stagnate in the holes and hinder heat transfer. Such a configuration is desirable, as when stagnated, the quenching material may boil and/or produce gases that may hinder heat transfer.

The configuration of the holes may also permit gases formed during quenching to escape with relative ease so that heat transfer during cooling may not be compromised. The configuration of the holes may also prevent gases from forming a "pocket" in the holes which may hinder heat transfer. Optionally, the holes may be plugged after the through hardening process, if desired, using, for example, shrink fit plugs or sleeves, snap rings, or threaded plugs.

Figure 2:
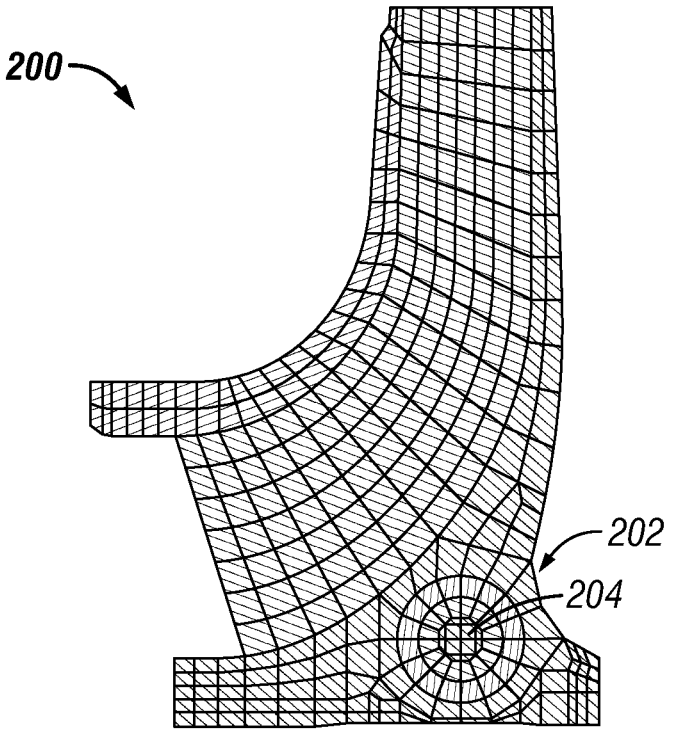
FIG. 2 illustrates a non-through hardened impeller model meshed for finite element stress analysis including approximated property contours, according to one or more embodiments disclosed.

FIG. 2 illustrates a non-through hardened impeller model meshed for finite element stress analysis including approximated property contours, according to one or more embodiments disclosed. FIG. 2 indicates the soft area 204 in the hub section 202 that did not harden as required. This soft area 204 is at or adjacent the central opening 110 of the hub section 202 and extends circumferentially around the hub section 202.

Figure 3:
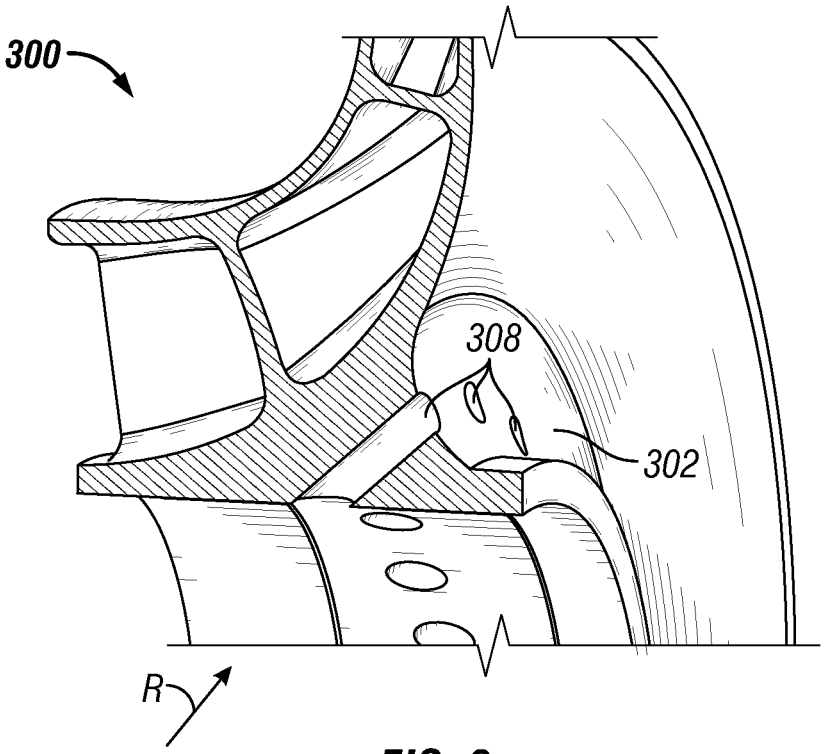
FIG. 3 illustrates a partial cross-sectional perspective view of an impeller having a plurality of through holes in the hub section, according to one or more embodiments disclosed.

FIG. 3 illustrates a partial cross-sectional perspective view of an impeller 300 showing a plurality of through holes 308 in the hub section 302, according to one or more embodiments disclosed. A through hole may refer to a hole that is reamed, drilled, or milled completely through a substrate, herein, the impeller.

Figure 4A:
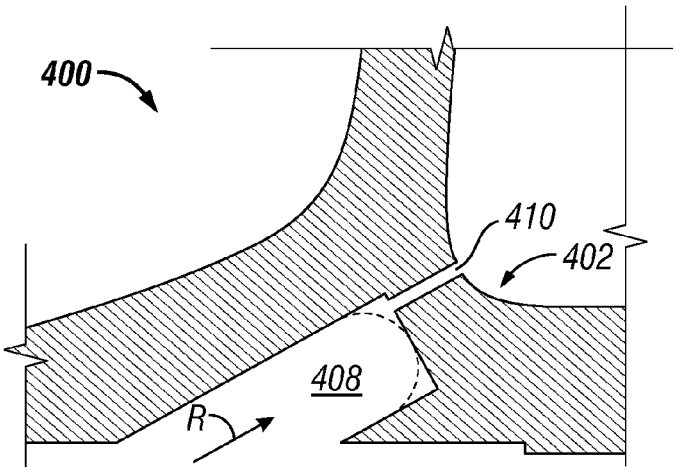
FIG. 4A illustrates a partial cross-sectional view of an impeller having a partially drilled hole and a bleed hole in the hub section, according to one or more embodiments disclosed.

In exemplary embodiments, not all holes in the hub section may be through holes. FIG. 4A illustrates a partial cross-sectional view of an impeller 400 having a partially drilled hole 408 (also referred to as a blind hole) and a bleed hole 410 in the hub section 402 of the impeller 400, according to one or more embodiments disclosed. A partially drilled hole or a blind hole may refer to a hole that is reamed, drilled, or milled to a specified depth, thus without breaking through to the other side of the substrate, herein, the impeller. Stated otherwise, a depth of a blind hole or a partially drilled hole may be less than the thickness of the substrate (herein, the impeller) at the location of the blind hole or the partially drilled hole. A bleed hole may refer to a hole or a passageway having one end opening into a partially drilled hole and the other end opening on the surface of the impeller. The bleed hole may have a diameter smaller than the partially drilled hole.

The hub section 402 may have a plurality of partially drilled holes 408. However, not all partially drilled holes may have a bleed hole. The bleed hole 410 may form a passageway between the partially drilled hole 408 and the surface of the impeller such that gases formed during a quenching process may escape from the partially drilled hole 408 (for example, during the initial moments of quenching). As illustrated in FIG. 4A, a surface of the impeller at an end of the partially drilled hole 408 in contact with the bleed hole 410 may be flat or rounded (illustrated in phantom). In an example embodiment, the surface of the impeller in contact with the bleed hole 410 may be conical (also referred to as a drill point end). However, the shape of the surface of the impeller is not limited thereto and may be of any desired shape to fit any number of applications without departing from the scope of the disclosure. It should be noted that the location of the bleed hole 410 in FIG. 4A is a design choice and the bleed hole 410 may be positioned at any desired location on the partially drilled hole 408 to fit any number of applications without departing from the scope of the disclosure.

The partially drilled hole 408 and the bleed hole 410 may alleviate noise generated during impeller operation. The geometry of a closed ended cavity (for example, a partially drilled hole) may generate noise when fluid of a given velocity passes over the closed ended cavity. The amount of noise generated may depend on the configuration of the cavity (for example, the shape (circular, rectangular, etc.), depth, width, wall design, or the like). Utilizing a bleed hole may reduce the opening area over which the fluid may flow thereby reducing the energy of noise generated.

Figure 4B:
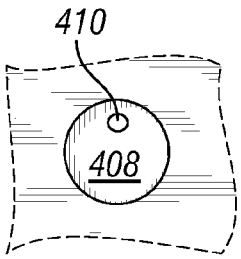
FIG. 4B illustrates a partially drilled hole and a bleed hole associated therewith as viewed in the direction of the arrow R in FIGS. 3 and 4A.

According to an exemplary embodiment, the impeller 300 of FIG. 3 may include one or more partially drilled holes instead of the though holes 308. The one or more partially drilled holes may have a bleed hole, as shown in FIG. 4A. FIG. 4B illustrates the partially drilled hole and the bleed hole associated therewith as viewed in the direction of the arrow R in FIGS. 3 and 4A.

Figure 5A:
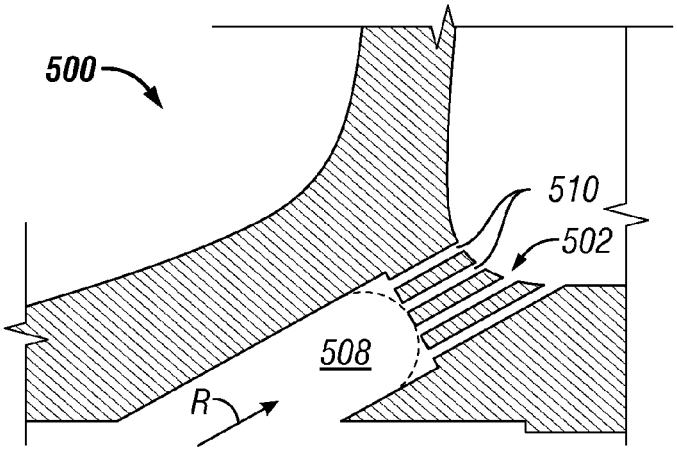
FIG. 5A illustrates a partial cross-sectional view of an impeller having a partially drilled hole and multiple bleed holes in the hub section, according to one or more embodiments disclosed.

In other exemplary embodiments, the hub section of the impeller may include a partially drilled hole having multiple bleed holes. FIG. 5A illustrates a partial cross-sectional view of an impeller 500 having a partially drilled hole 508 and multiple bleed holes 510 in the hub section 502, according to one or more embodiments disclosed. The multiple bleed holes 510 may allow gases to escape more rapidly from the partially drilled hole 508 and may increase the quenching material flow, as compared to the single bleed hole 410 in FIG. 4A. Such a configuration may attenuate noise generated by the partially drilled hole 508. As mentioned above, utilizing a bleed hole may reduce the opening area over which the fluid may flow, thereby reducing the energy of any noise generated. Instead of using a single bleed hole, multiple bleed holes may be used. The configuration including partially drilled holes with multiple bleed holes may be based, for example, on the Helmholtz resonator principle according to which the multiple bleed holes dissipate noise. Examples of Helmholtz resonators are disclosed in U.S. Pat. Nos. 6,550,574; 6,601,672; and 7,984,787, which are incorporated herein by reference to the extent these disclosures are consistent with the present disclosure.

Figure 5B:
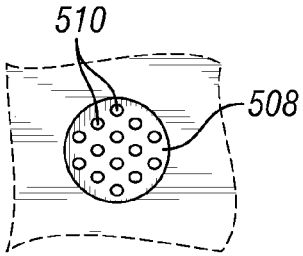
FIG. 5B illustrates a partially drilled hole and multiple bleed holes associated therewith as viewed in the direction of the arrow R in FIGS. 3 and 5A.

According to another exemplary embodiment, the impeller 300 of FIG. 3 may include one or more partially drilled holes instead of the though holes 308. The one or more partially drilled holes may each have multiple bleed holes, as shown in FIG. 5A. FIG. 5B illustrates the partially drilled hole and the multiple bleed holes associated therewith as viewed in the direction of the arrow R in FIGS. 3 and 5A.

A hub section of an impeller, according to one or more embodiments disclosed, may have holes that are either through holes or partially drilled holes (blind holes). All of the partially drilled holes may have either flat ends, conical ends, or rounded ends. Alternatively, some of the partially drilled holes may have flat ends, while others may have conical ends, while still others may have rounded ends. Additionally, some or all of the partially drilled holes (having either flat, conical, or rounded ends) may have one or more bleed holes.

Example embodiments described above provide a relatively simple technique of exposing the thick areas of an impeller to the quenching material with a minimal impact on stresses during operation. These techniques to achieve desired mechanical properties in the hub section of the impeller are advantageous over prior art solutions that involve expensive manufacturing techniques and/or design that greatly weaken the impeller, and include materials and/or manufacturing processes that are magnitudes higher in cost.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

We claim:

1. An impeller configured to be mounted on a rotatable shaft, comprising:

a hub section having an inner annular surface extending axially from an upstream surface of the impeller to a downstream surface of the impeller, the inner annular surface defining a central opening for the rotatable shaft to extend therethrough, and the inner annular surface further defining in part a plurality of holes circumferentially spaced from one another, each hole of the plurality of holes extending from the central opening toward the downstream surface of the impeller;

a plurality of blades connected to or integral with the hub section and the upstream surface of the impeller, such that the plurality of blades extend axially from the upstream surface of the impeller; and a shroud connected to or integral with the hub section and the plurality of blades.

2. The impeller of claim 1, wherein a thickness of the hub section decreases radially outward from the central opening.

3. The impeller of claim 2, wherein the plurality of holes are circumferentially spaced from one another at equal intervals.

4. The impeller of claim 1, wherein at least one hole of the plurality of holes is a through hole.

5. The impeller of claim 1, wherein at least one hole of the plurality of holes is a blind hole.

6. The impeller of claim 5, wherein a surface of the impeller at a bottom of the at least one blind hole is flat, conical, or rounded.

7. The impeller of claim 5, wherein the hub section further defines at least one bleed hole, the at least one bleed hole forming a passageway between the at least one blind hole and the downstream surface of the impeller.

8. The impeller of claim 7, wherein the passageway is configured to permit quenching material to flow therethrough and prevent stagnation of the quenching material therein.

9. The impeller of claim 1, wherein the plurality of holes include at least one through hole and at least one blind hole.

10. The impeller of claim 9, wherein the plurality of holes are circumferentially spaced from one another at equal intervals.

11. The impeller of claim 9, wherein a surface of the impeller at a bottom of the at least one blind hole is flat, conical, or rounded.

12. The impeller of claim 9, wherein the hub section further defines at least one bleed hole, the at least one bleed hole forming a passageway between the at least one blind hole and the downstream surface of the impeller.

13. The impeller of claim 12, wherein the passageway is configured to permit quenching material to flow therethrough and prevent stagnation of the quenching material therein.

14. An impeller, comprising:

a hub section having an inner annular surface extending axially from an upstream surface of the impeller to a downstream surface of the impeller, the inner annular surface defining a central opening for a rotatable shaft to extend therethrough, a thickness of the hub section decreasing radially outward from the central opening, and the inner annular surface further defining in part at least one through hole and at least one blind hole circumferentially spaced from one another, each of the at least one through hole and the at least one blind hole extending from the central opening toward the downstream surface of the impeller;

a plurality of blades connected to or integral with the hub section and the upstream surface of the impeller, such that the plurality of blades extend axially from the upstream surface of the impeller; and a shroud connected to or integral with the hub section and the plurality of blades.

15. The impeller of claim 14, wherein the hub section further defines at least one bleed hole, the at least one bleed hole forming a passageway between the at least one blind hole and the downstream surface of the impeller.

16. The impeller of claim 15, wherein the passageway is configured to permit quenching material to flow therethrough and prevent stagnation of the quenching material therein.

17. The impeller of claim 14, wherein a surface of the impeller at a bottom of the at least one blind hole is flat, conical, or rounded.

18. The impeller of claim 14, wherein the at least one through hole and the at least one blind hole are circumferentially spaced from one another at equal intervals.

19. An impeller, comprising:

a hub section defining one or more bleed holes and having an inner annular surface extending axially from an upstream surface of the impeller to a downstream surface of the impeller, the inner annular surface defining a central opening for a rotatable shaft to extend therethrough, a thickness of the hub section decreasing radially outward from the central opening, and the inner annular surface further defining in part at least one blind hole in fluid communication with the one or more bleed holes, the at least one blind hole extending from the central opening toward the downstream surface of the impeller;

a plurality of blades connected to or integral with the hub section and the upstream surface of the impeller, such that the plurality of blades extend axially from the upstream surface of the impeller; and a shroud connected to or integral with the hub section and the plurality of blades.

20. The impeller of claim 19, wherein the one or more bleed holes form a passageway between the at least one blind hole and the downstream surface of the impeller.

* * * * *